US010384895B2

(12) United States Patent
Yokoya et al.

(10) Patent No.: US 10,384,895 B2
(45) Date of Patent: Aug. 20, 2019

(54) IMAGE FORMING APPARATUS, IMAGE FORMING SYSTEM AND DETECTING METHOD OF ABNORMAL FEEDING

(71) Applicant: CANON KABUSHIKI KAISHA, Tokyo (JP)

(72) Inventors: Takashi Yokoya, Yoshikawa (JP); Akinobu Nishikata, Matsudo (JP); Satoru Yamamoto, Noda (JP); Koji Yumoto, Toride (JP); Akihiro Kawakita, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/991,015

(22) Filed: May 29, 2018

(65) Prior Publication Data

US 2018/0346270 A1 Dec. 6, 2018

(30) Foreign Application Priority Data

May 31, 2017 (JP) ..... 2017-108336

(51) Int. Cl.
*B65H 7/04* (2006.01)
*B65H 7/06* (2006.01)
(Continued)

(52) U.S. Cl.
CPC ..... *B65H 7/04* (2013.01); *B41F 33/02* (2013.01); *B41F 33/06* (2013.01); *B65H 1/266* (2013.01); *B65H 3/44* (2013.01); *B65H 7/06* (2013.01); *B65H 7/20* (2013.01); *B65H 2402/10* (2013.01); *B65H 2405/15* (2013.01);
(Continued)

(58) Field of Classification Search
CPC ... B65H 7/04; B65H 7/06; B65H 7/20; B65H 1/266; B65H 3/44; B65H 2402/10; B65H 2405/15; B65H 2405/312; B65H 2405/331; B65H 2405/332; B65H 2511/20; B65H 2511/515; B65H 2511/528; B65H 2513/511; B65H 2551/26; B65H 2551/27; B41F 33/02; B41F 33/06
See application file for complete search history.

(56) References Cited

U.S. PATENT DOCUMENTS 5,149,080 A 9/1992 Yamamoto
5,348,287 A 9/1994 Yamamoto et al.
(Continued)

FOREIGN PATENT DOCUMENTS

JP 2006-111388 A 4/2006

*Primary Examiner* — David H Bollinger
(74) *Attorney, Agent, or Firm* — Venable LLP

(57) ABSTRACT

An image forming apparatus to which a first feeding device which does not notify abnormal sheet feeding or a second feeding device which notifies the abnormal sheet feeding is connectable includes a sheet receiving portion, a sheet detector, an image forming unit, and a controller. In a case that the first feeding device is connected to the image forming apparatus, the controller discriminates that the abnormal sheet feeding occurs in the first feeding device when the detector does not detect the sheet at first timing. In a case that the second feeding device is connected to the image forming apparatus, the controller discriminates that the abnormal sheet feeding occurs at the sheet receiving portion when the detector does not detect the sheet at second timing and notification of the abnormal sheet feeding is not provided from the second feeding device.

10 Claims, 12 Drawing Sheets

(51) Int. Cl.

| | |
|---|---|
| ***B41F 33/06*** | (2006.01) |
| ***B41F 33/02*** | (2006.01) |
| ***B65H 1/26*** | (2006.01) |
| ***B65H 3/44*** | (2006.01) |
| ***B65H 7/20*** | (2006.01) |

(52) U.S. Cl.

CPC .. *B65H 2405/312* (2013.01); *B65H 2405/331* (2013.01); *B65H 2405/332* (2013.01); *B65H 2511/20* (2013.01); *B65H 2511/515* (2013.01); *B65H 2511/528* (2013.01); *B65H 2513/511* (2013.01); *B65H 2551/26* (2013.01); *B65H 2551/27* (2013.01)

(56) References Cited

U.S. PATENT DOCUMENTS

| | | | | |
|---|---|---|---|---|
| 5,588,758 | A | 12/1996 | Yamamoto | |
| 5,642,949 | A | 7/1997 | Yamamoto | |
| 6,421,523 | B1 | 7/2002 | Kondo et al. | |
| 6,751,426 | B2 | 6/2004 | Akiba et al. | |
| 7,878,496 | B2 | 2/2011 | Fujii et al. | |
| 8,038,139 | B2 | 10/2011 | Nishimura et al. | |
| 8,145,081 | B2 | 3/2012 | Nishikata | |
| 8,157,255 | B2 | 4/2012 | Nishimura et al. | |
| 8,260,162 | B2 | 9/2012 | Nishikata | |
| 8,561,978 | B2 | 10/2013 | Takahashi et al. | |
| 8,749,816 | B2 | 6/2014 | Sunada et al. | |
| 9,383,708 | B1 * | 7/2016 | Imaizumi | G03G 15/70 |
| 2005/0254842 | A1 * | 11/2005 | Morisaki | B65H 7/06 399/16 |
| 2015/0014914 | A1 * | 1/2015 | Sung | H04N 1/00652 271/110 |
| 2015/0077450 | A1 * | 3/2015 | Knechten | B41J 3/407 347/9 |
| 2016/0304305 | A1 * | 10/2016 | Link | B65H 7/06 |
| 2017/0045854 | A1 | 2/2017 | Miyake et al. | |
| 2017/0239967 | A1 * | 8/2017 | Suzuki | B41J 2/01 |

* cited by examiner (a)

(b)

(c)

(d)

IMAGE FORMING APPARATUS, IMAGE FORMING SYSTEM AND DETECTING METHOD OF ABNORMAL FEEDING

FIELD OF THE INVENTION AND RELATED ART

The present invention relates to an image forming apparatus, an image forming system and a detecting method of abnormal feeding of a sheet in the image forming apparatus or the image forming system.

In an image forming system, to an image forming apparatus for forming an image on a sheet, a plurality of sheet (paper) feeding devices for feeding sheets are connected in series along a sheet feeding direction in some cases. In the image forming system disclosed in Japanese Laid-Open Patent Application 2006-111388, when a jam such as a sheet (paper) jam occurs in the sheet feeding device provided in an upstreammost position with respect to the sheet feeding direction, the sheet is fed from the sheet feeding device provided immediately downstream of the upstreammost sheet feeding device. Further, the image forming system stops sheet feeding from the sheet feeding device(s) provided in position(s) upstream of a jam occurrence position with respect to the sheet feeding direction.

As the sheet feeding device, there are a sheet feeding device having a constitution in which abnormality such as an occurrence of a jam in the sheet feeding device or a sheet (paper) absence state in which sheets accommodated in the sheet feeding device is used up is detectable and a sheet feeding device having a constitution in which the abnormality cannot be detected. The jam includes a delay jam and a stagnation jam. The delay jam is detected when a sheet detecting sensor cannot detect the sheet at predetermined timing. The stagnation jam is detected when a sensor continuously detect the sheet due to stagnation of the sheet to be fed.

When the image forming system includes an image forming apparatus, a first sheet feeding device and a second sheet feeding device, there is a possibility of the occurrence of the delay jam and the stagnation jam in each of the sheet feeding device and the second sheet feeding device. Incidentally, the first sheet feeding device is disposed on an upstreammost side with respect to the sheet feeding direction, and the second sheet feeding device is disposed between the first sheet feeding device and the image forming apparatus. Each of the first sheet feeding device and the second sheet feeding device is capable of detecting the abnormality therein. In the case where the second sheet feeding device detected the delay jam at an entrance portion where the second sheet feeding device receives the sheet from the first sheet feeding device, the delay jam of the sheet which cannot be detected as being jammed in the first sheet feeding device is detected by the second sheet feeding device. This means that the delay jam occurred due to that the second sheet feeding device cannot normally receive the sheet from the first sheet feeding device.

On the other hand, in the case where the first sheet feeding device has no function of detecting abnormal feeding of the sheet, the cause of the delay jam detected by the second sheet feeding device cannot be discriminated as to whether the delay jam occurred in the first sheet feeding device or the second sheet feeding device. The second sheet feeding device cannot discriminate whether the delay jam is caused due to the sheet absence state of the first sheet feeding device or the occurrence of the jam. In the case where the image forming system notifies a user that the jam occurred in the second sheet feeding device although the abnormality occurred in the first sheet feeding device, the user cannot find the abnormality of the first sheet feeding device, and therefore, there is a possibility that it is difficult to eliminate the abnormality. Accurate guidance to the user for the purpose of eliminating the abnormality cannot be provided, and therefore, usability of the image forming system lowers.

SUMMARY OF THE INVENTION

In view of the above problem, a principal object of the present invention is to provide an image forming apparatus capable of properly addressing the problem when abnormal feeding of a sheet occurs, depending on a kind of a sheet feeding device connected with the image forming apparatus on a user side with respect to a sheet feeding direction.

According to an aspect of the present invention, there is provided an image forming apparatus to which a first feeding device which does not notify abnormal feeding of a sheet during therein sheet feeding or a second feeding device which notifies the abnormal feeding of the sheet during the sheet feeding therein is connectable, the image forming apparatus comprising: a sheet receiving portion configured to receive the sheet from the first feeding device or the second feeding device; a detector provided at the sheet receiving portion and configured to detect the sheet received by the sheet receiving portion; an image forming unit configured to form an image on the sheet received by the sheet receiving portion; and a controller configured to discriminate occurrence of the abnormal feeding of the sheet, wherein in a case that the first feeding device is connected to the image forming apparatus, the controller discriminates that the abnormal feeding of the sheet occurs in the first feeding device when the detector does not detect the sheet at first timing of the sheet fed from the first feeding device being predicted to reach the detector, and in a case that the second feeding device is connected to the image forming apparatus, the controller discriminates that the abnormal feeding of the sheet occurs at the sheet receiving portion when the detector does not detect the sheet at second timing of the sheet fed from the second feeding device being predicted to reach the detector and notification of the abnormal feeding of the sheet is not provided from the second feeding device.

Further features of the present invention will become apparent from the following description of exemplary embodiments with reference to the attached drawings.

Figure 8:
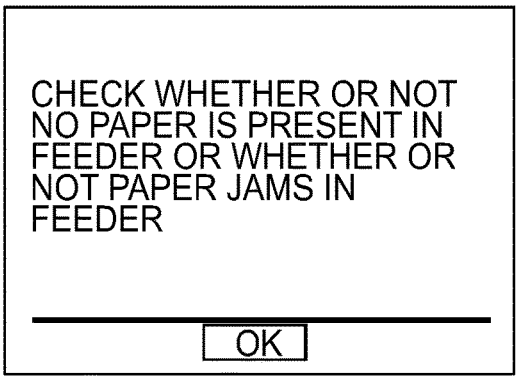
Figure 8:
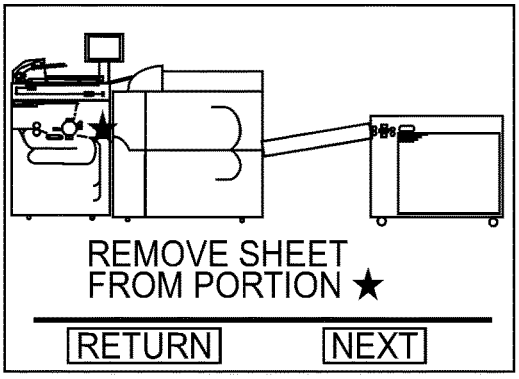
Figure 8:
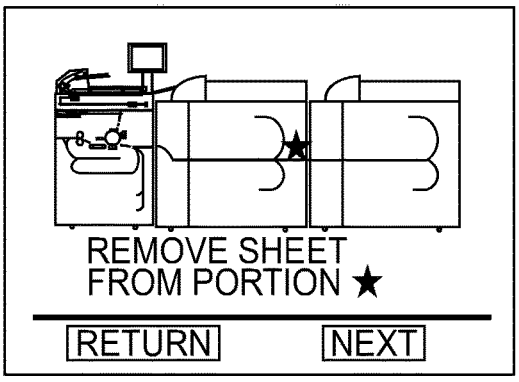
Figure 8:
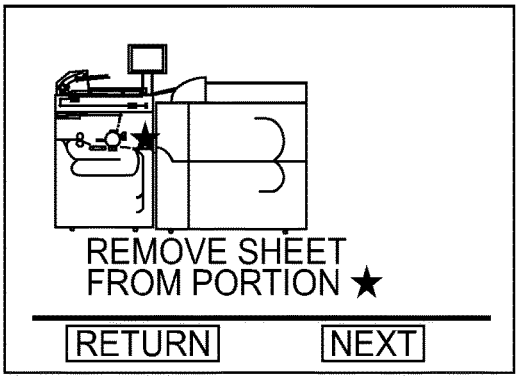

Parts (a) to (d) of FIG. 8 are schematic views of screens displayed at a display portion.

Figure 9:
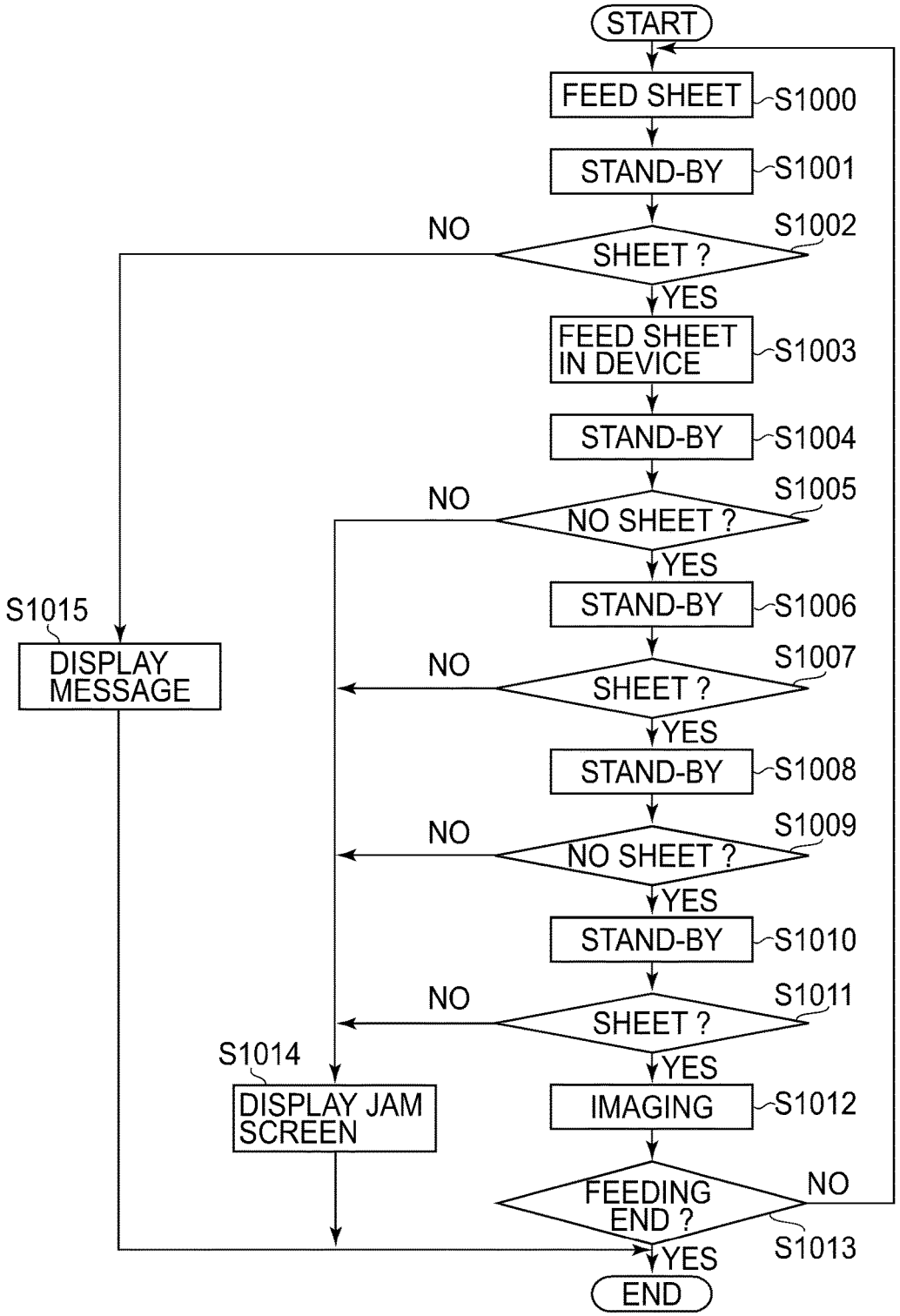

FIG. 9 is a flowchart showing a sheet feeding process.

Figure 10:
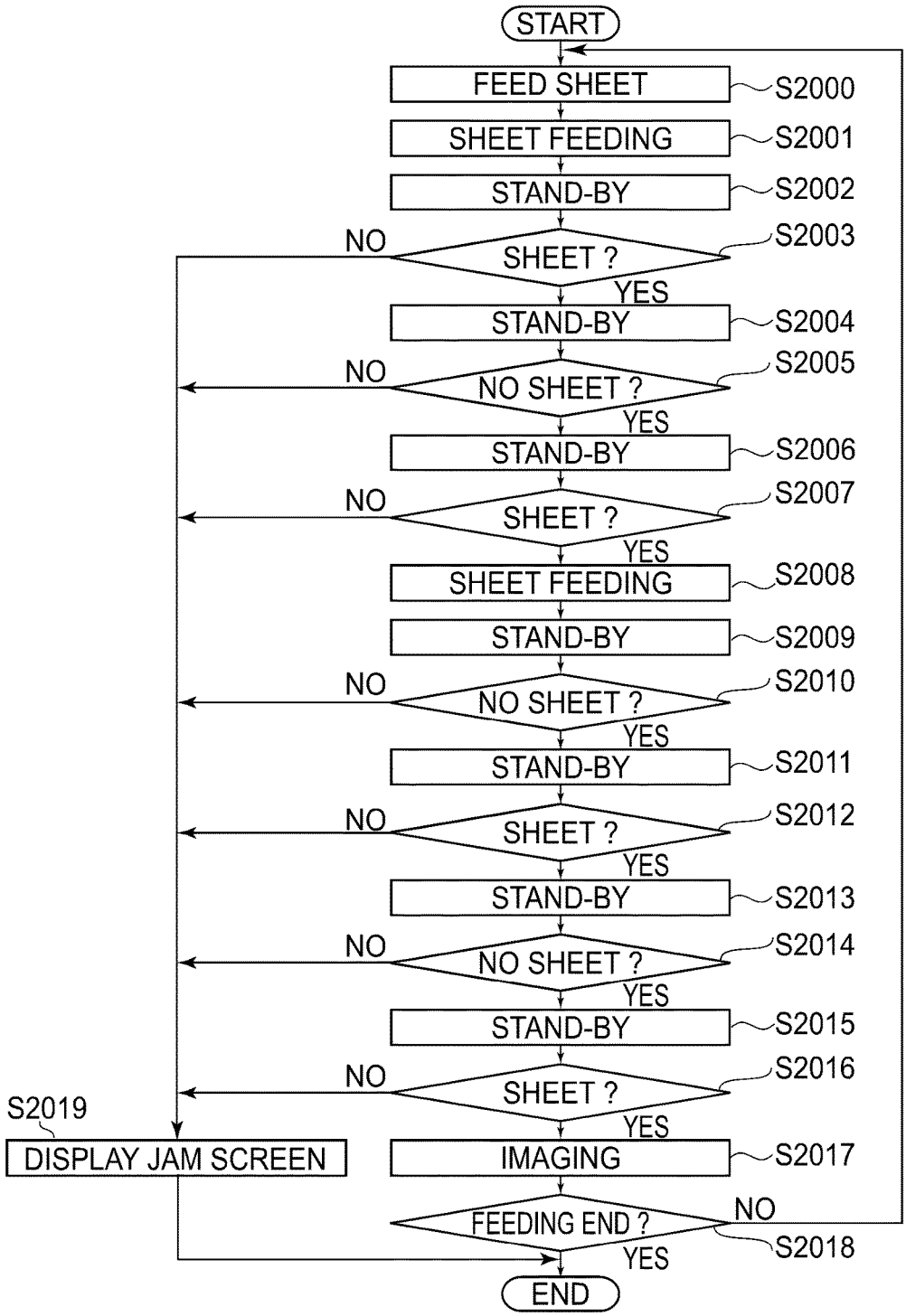

FIG. 10 is a flowchart showing another sheet feeding process.

Figure 11:
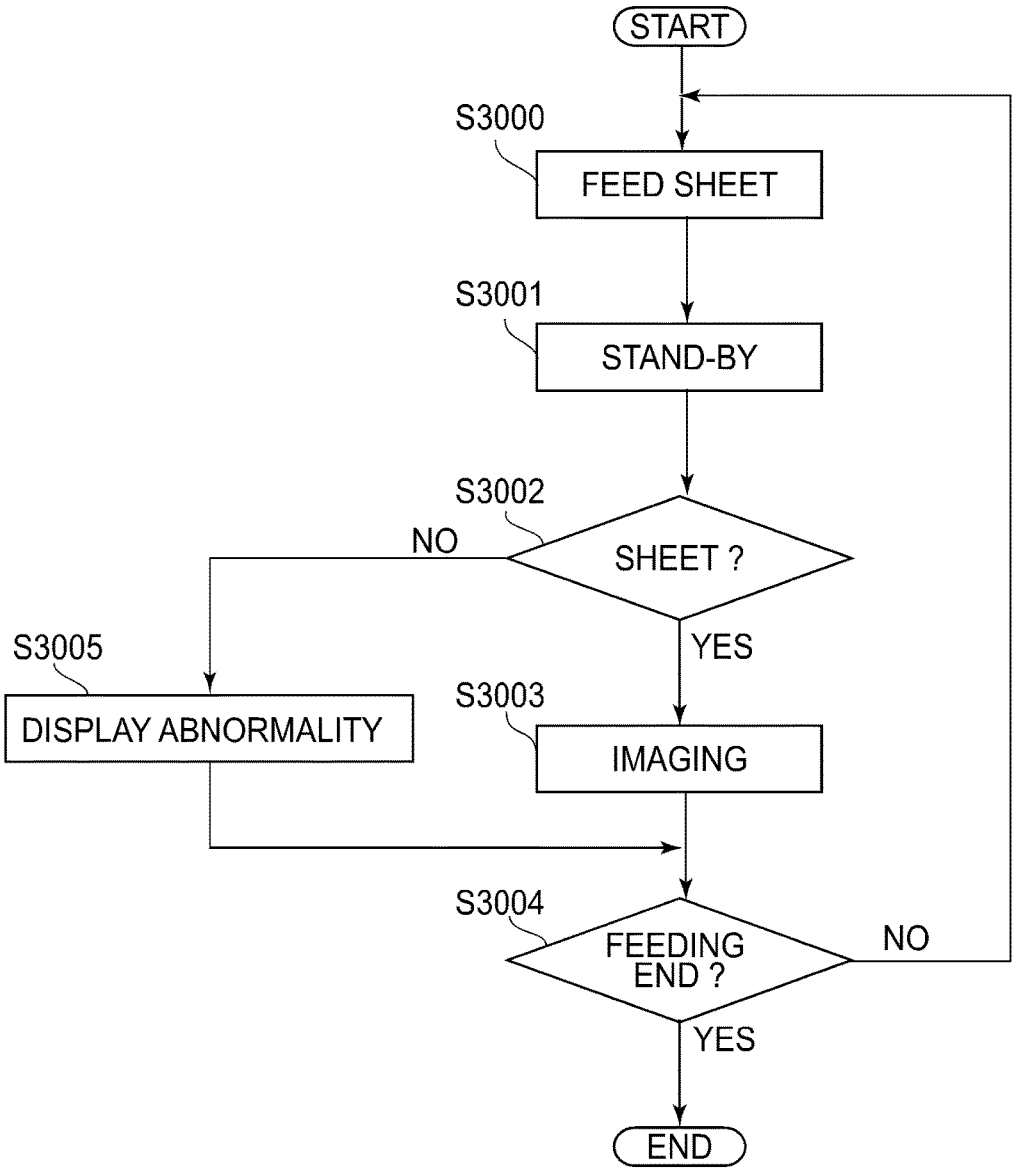

FIG. 11 is a flowchart showing another sheet feeding process.

Figure 12:
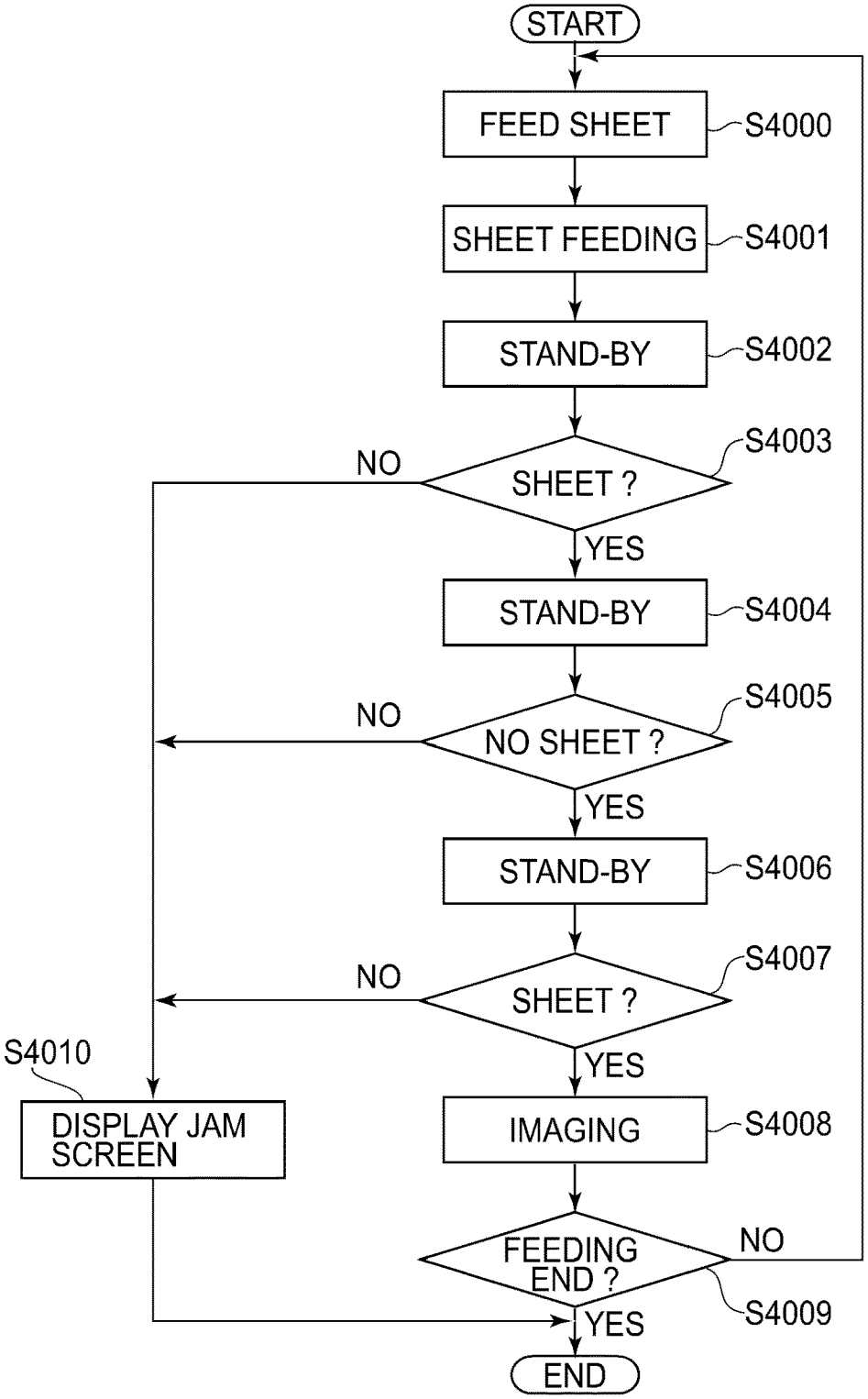

FIG. 12 is a flowchart showing another sheet feeding process.

DESCRIPTION OF EMBODIMENTS

An image forming apparatus according to the present invention will be specifically described with reference to the drawings.

(General Structure)

Figure 1:
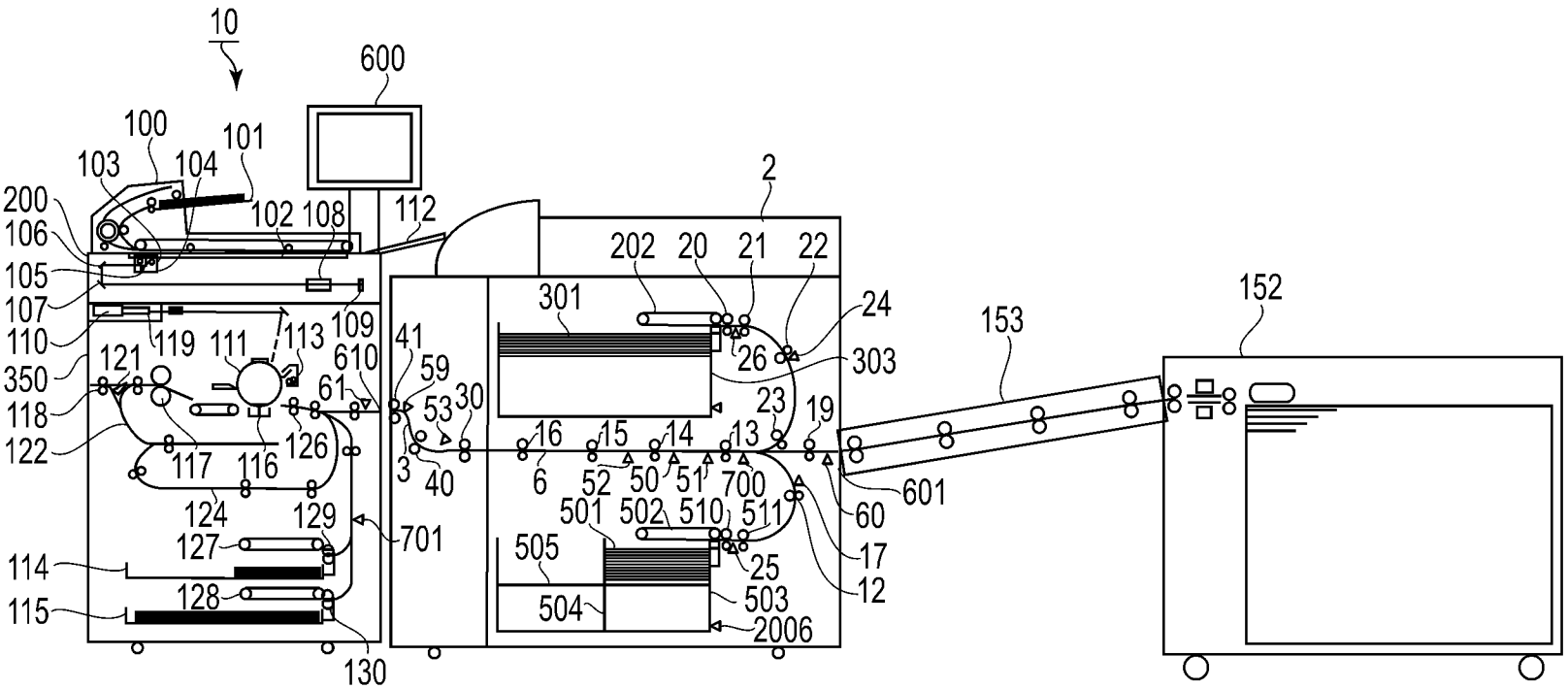
FIG. 1 is a schematic view of an example of a structure of an image forming system.

FIG. 1 is a schematic view of an example of a structure of an image forming system in an embodiment. The image forming system includes an image forming apparatus 10, a sheet feeding device 2 and an elongated sheet feeder (elongated feeder) 152. In the image forming system, from a user side with respect to a sheet feeding direction, the elongated sheet feeder 152, the sheet feeding device 2 and the image forming apparatus 10 are provided in a named order. The image forming apparatus 10 includes an image reader 200 for reading an image from an original, a printer 350 for forming the image read by the image reader 200, and an operation display device 600. The image reader 200 includes an ADF (automatic document feeder) 100. The elongated sheet feeder 152 is a sheet feeding device capable of supplying a sheet which cannot be supplied by the sheet feeding device 2. The elongated sheet feeder 152 includes a registration adjusting device 153 between itself and the sheet feeding device 2. The sheet feeding device 2 delivers the sheet, received from the elongated sheet feeder 152, to the image forming apparatus 10.

(Structure of Image Forming Apparatus)

The ADF 100 feeds originals, stacked on an original tray 101, one by one sequentially to an image reading position of the image reader 200, and discharges the originals, from which images are read, to a discharge tray 112. The image reader 200 reads images from the originals during feeding.

The image reader 200 includes a platen glass 102, a scanner user 104, reflection mirrors 106 and 107, a lens 108 and an image sensor 109. The image reader 200 is capable of reading an image from an original placed on the platen glass 102 and reading an image on an original fed along a surface of the platen glass 102 by the ADF 100. The scanner user 104 includes a lamp 103 and a reflection mirror 105. The lamp 103 emits light to the original on the platen glass 102. Reflected light from the original is guided to the lens 108 via the reflection mirrors 105 to 107. An image is formed on an imaging area of the image sensor 109 through the lens 108. The image sensor 109 generates image data representing a read original image, depending on received reflection light. The image data is sent from the image reader 200 to a printer 350. Incidentally, in the case where the image is read from the original fed by the ADF 100, a position of the scanner user 104 is fixed. This is referred to as a first reading method. In the case where the image is read from the original placed on the platen glass 102, the scanner user 104 moves in a left-right direction in FIG. 1. This is referred to as a second reading method.

The printer 350 carries out an image forming process by an exposure portion 110, a photosensitive drum 111 and a fixing portion 117. The exposure portion 110 outputs laser light modulated on the basis of the image data acquired from the image reader 200. The surface of the photosensitive drum 111 is scanned with the laser light reflected by a polygon mirror 119. On the surface of the photosensitive drum 111, an electrostatic latent image depending on the laser light is formed. Here, the exposure portion 110 outputs the laser light so that an erect image (an image which is not a mirror image) is formed during original fixing reading. The electrostatic latent image formed on the photosensitive drum 111 is visualized as a developer image (toner image) by a developer (toner) supplied from a developing device 113.

A sheet on which the image is formed by the image forming process is supplied from sheet feeding cassettes 114 and 115 or from a side of a sheet feeding device 12. Sheets accommodated in the sheet feeding cassettes 114 and 115 are fed one by one from the sheet feeding cassettes 114 and 115 by attraction belts 127 and 128, respectively, and are fed to a registration roller pair 126 by drawing rollers 129 and 130, respectively. Between the drawing rollers 129 and 130 and the registration roller pair 126, a multi-feed (double feed) detecting sensor 701 is provided. As regards the sheets supplied from the sheet feeding cassettes 114 and 115, in the case where two or more sheets are fed in a superposed state, multi-feeding (double feeding) is reached by the multi-feed sensor 701.

The printer 350 is provided with an entrance sensor 61, for detecting the sheet supplied from the sheet feeding device 2, at an entrance portion 610 to which the sheet is delivered from the sheet feeding device 2. In the case where the entrance sensor 61 cannot detect the sheet at predetermined timing, the printer 350 discriminates that a delay jam occurred. In the case where after the entrance sensor 61 detects the sheet at the predetermined timing, the entrance sensor 61 is not changed in state to a non-detection state until the time reaches second predetermined timing, the printer 350 discriminates that a stagnation jam occurred.

When a leading end of the sheet reaches the registration roller pair 126, the registration roller pair 126 drives at predetermined timing. The registration roller pair 126 feeds the sheet to between the photosensitive drum 111 and a transfer portion 116 at timing synchronized with a start of irradiation of the photosensitive drum surface with the laser light by the exposure portion 110. At the transfer portion 116, the developer image is transferred from the photosensitive drum 111 onto the sheet.

The sheet on which the sheet is transferred is converted to the fixing portion 117. The fixing portion 117 fixes the developer image on the sheet under application of heat and pressure. The sheet passed through the fixing portion 117 is discharged to an outside of the image forming apparatus 10 via a flapper 121 and a discharging roller pair 118.

In the case where the sheet is discharged in a state an image forming surface of the sheet is oriented downward (face down state), the sheet passed through the fixing portion 117 is once guided into a reversing path 122 by a switching operation of the flapper 121. Then, a trailing end of the sheet passes through the flapper 121, the sheet is switched back and is discharged from the printer 350 by the discharging roller pair 118. Such a sheet discharging mode is referred to as a "reverse sheet discharging (mode)". The reverse sheet discharging is used in the case where image formation is carried out from a first page. In the reverse sheet discharging, an order of discharged sheets is a proper page order.

In the case where double-side recording in which the images are formed on double sides (both surfaces) of the sheet is set, the sheet is conveyed to a feeding path 124 for double-side recording after being guided into the reversing path 122 by the switching operation of the flapper 121. The sheet guided to the feeding path 124 for double-side recording is fed again to between the photosensitive drum 111 and the transfer portion 116 at the above-described timing, so that the image formation is carried out.

(Structure of Operation Display Portion)

Figure 2:
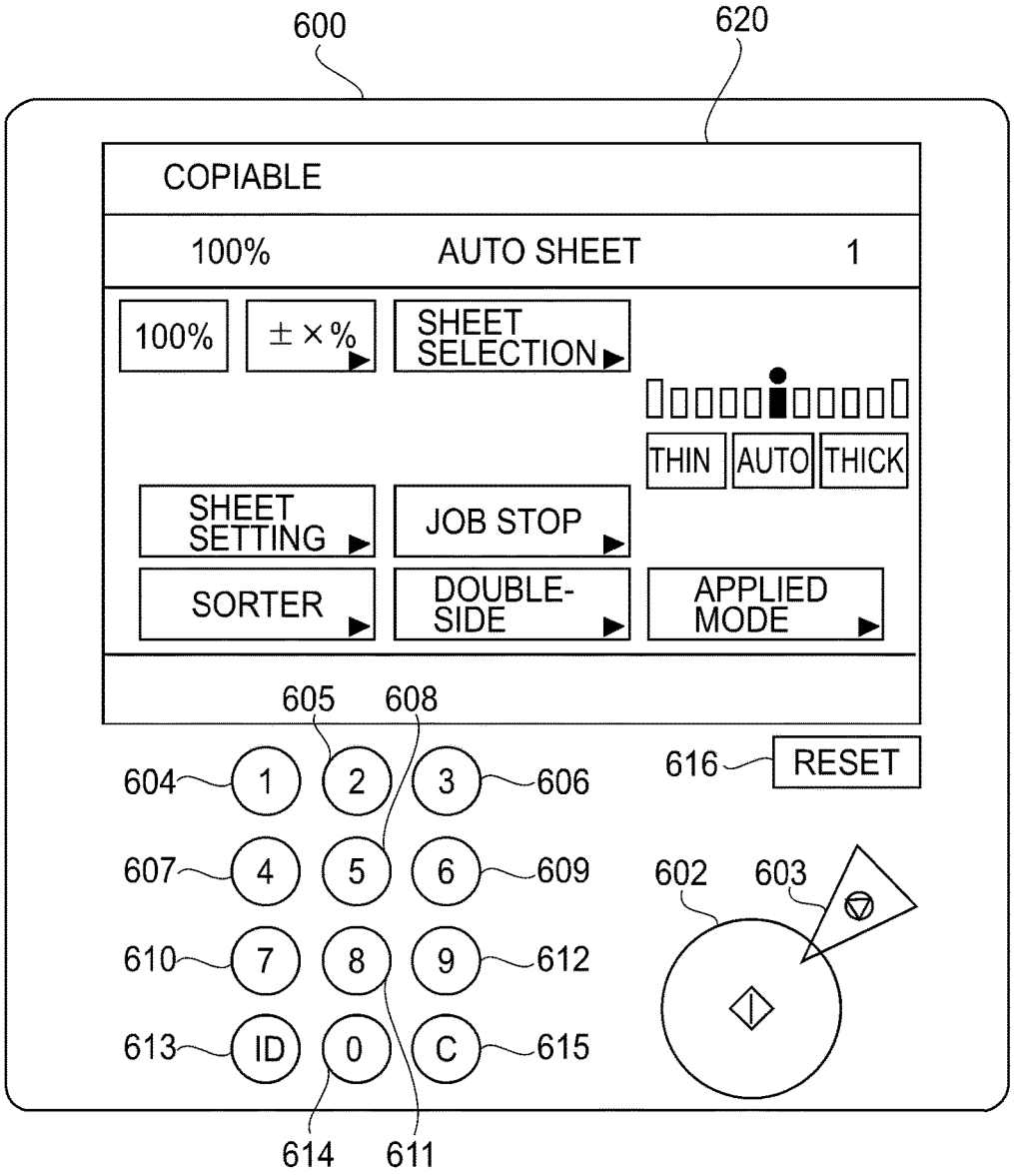
FIG. 2 is a schematic view of an example of an outer appearance of an operation display device.

An operation display device 600 is a user interface. FIG. 2 is a schematic view of an example of an outer appearance of the operation display device 600. The operation display portion 600 includes various keys as an inputting device and includes a display device 600 as an outputting device. The various keys include a start key 602, a stop key 603 instructing interruption of the image forming operation, numeric keys 604 to 612 and 614, an ID key 613, a clear key 615, a reset key 616 and the like. The display portion 620 displays images indicating various pieces of information. The display portion 620 is provided with a touch panel, and on a screen of the touch panel, software keys are displayed.

(Structure of Sheet Feeding Device)

The sheet feeding device 2 includes a sheet accommodating portion 503 for accommodating a plurality of sheets (sheet bundle) 501 and a sheet accommodating portion 303 for accommodating a plurality of sheets (sheet bundle) 301. The sheet accommodating portion 503 includes a trailing end guide 504 moved depending on a size of the sheets accommodated therein. The trailing end guide 504 regulates a trailing end side of the sheets with respect to a feeding direction so that a leading end side of the sheets with respect to the feeding direction contacts a leading end side of the sheet accommodating portion 503 with respect to the feeding direction and that the leading ends of the sheets are aligned with each other. The sheet accommodating portion 503 includes a lifter 505 for raising and lowering the sheet bundle 501. At a lowest position where the lifter 505 can be lowered, a lower limit sensor 2006 is provided. When the lower limit sensor 2006 detects the lifter 505, the lowering of the lifter 505 is stopped.

The sheets accommodated in the sheet accommodating portion 503 are fed one by one with an attraction belt 502 and are fed to a feeding path 6 by a drawing roller 510 and feeding roller pairs 511 and 12. The sheets accommodated in the sheet accommodating portion 303 are fed one by one with an attraction belt 202 and are fed to the feeding path 6 by a drawing roller 20 and feeding roller pairs 21, 22 and 23. The feeding path 6 is provided with feeding roller pairs 13, 14, 15 and 16. The feeding roller pairs 13, 14, 15 and 16 feeds the sheet from the feeding path 6 to a feeding path 3. The feeding path 3 is provided with feeding roller pairs 30, 40 and 41. The feeding roller pairs 30, 40 and 41 deliver the sheet from the feeding path 3 to the entrance portion 610 of the printer 350.

Along a sheet feeding path from the sheet accommodating portions 503 and 303 to the entrance portion 610 of the printer 350, sheet detecting sensors 17, 24, 25, 26, 50, 51, 52, 53 and 59 for detecting the presence or absence of the sheet are provided. The respective rollers for feeding the sheet is driven and controlled on the basis of detection results of the sheet detecting sensors 17, 24, 25, 26, 50, 51, 52, 53 and 59. The feeding path 6 is provided with a multi-feed detecting sensor 700. In the case where two or more sheets are fed from the sheet accommodating portions 503 and 303 in a superposed state, multi-feeding is detected by the multi-feed detecting sensor 700.

The sheet feeding device 2 is capable of supplying the sheets from an elongated sheet feeder 152, in addition to the sheet accommodating portions 503 and 303. The sheet feeding device 2 receives the sheet delivered from the elongated sheet feeder 152 and feeds the sheet to the feeding path 6 by a feeding roller pair 19. The sheet feeding device 2 includes an entrance sensor 60 for detecting the sheet supplied from the elongated sheet feeder 152 thereto through the entrance portion 601. In the case where the entrance sensor 60 cannot detect the sheet at predetermined timing, the sheet feeding device 2 discriminates that the delay jam occurred. In the case where after the entrance sensor 60 detects the sheet at the predetermined timing, the entrance sensor 60 is not changed in state to a non-detection state until the time reaches second predetermined timing, the sheet feeding device 2 discriminates that the stagnation jam occurred.

(Structure of Elongated Sheet Feeder)

Figure 3:
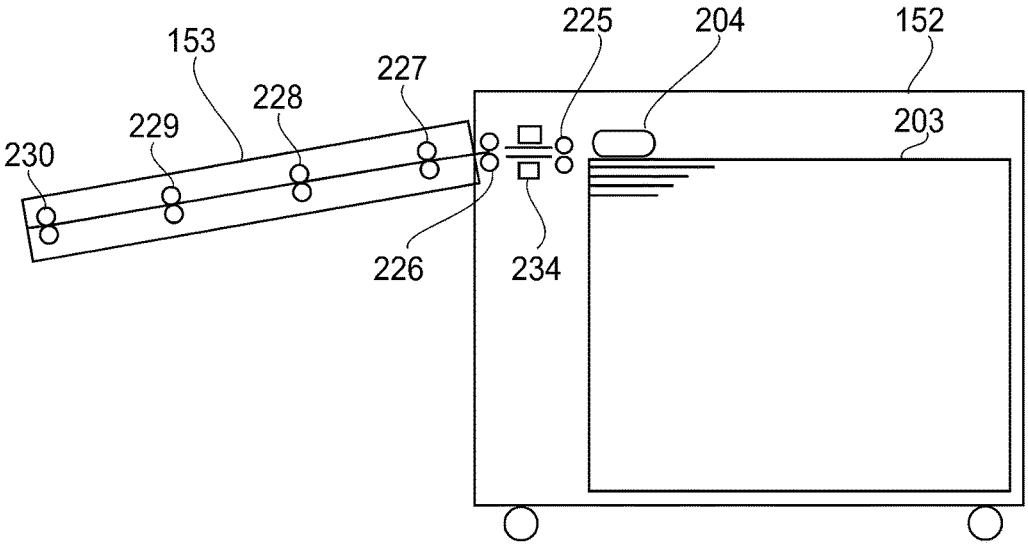
FIG. 3 is a schematic view of an example of structures of an elongated sheet feeder and a registration adjusting device.

The elongated sheet feeder 152 is capable of accommodating sheets, having a size (for example, a size long in the feeding direction), which cannot be accommodated by the sheet feeding device 2 of the image forming apparatus 10. FIG. 3 is a schematic view of an example of the elongated sheet feeder 152 and a registration adjusting device 153. Incidentally, the elongated sheet feeder 152 and the registration adjusting device 153 are not genuine devices manufactured by a manufacturing company, but are general-purpose feeding devices. For that reason, advanced (detailed) communication performed between itself and the image forming apparatus 10 or the sheet feeding device 2 cannot be carried out, and general-purpose communication between itself and the image forming apparatus 10 or the sheet feeding device 2 can only be carried out.

The elongated sheet feeder 152 includes a sheet accommodating portion 203 accommodating sheets therein and includes an attraction feeding portion 204 and feeding roller pairs 225 and 226 which are used for feeding the sheets from the sheet accommodating portion 203 to the registration adjusting device 153. Between the feeding roller pair 225 and the feeding roller pair 226, a multi-feed detecting sensor 234 is provided. The attraction feeding portion 204 feeds the sheets one by one from the sheet accommodating portion 203. The feeding roller pairs 225 and 226 feed the sheet fed by the attraction feeding portion 204 and deliver the sheet to the registration adjusting device 153. The multi-feed detecting sensor 234 detects multi-feeding of two or more sheets fed from the sheet accommodating portion 203 is a superposed state. The elongated sheet feeder 152 is provided with an unshown sheet length detecting sensor along a sheet feeding path, and a length of the sheet fed in the feeding direction is detected by the sheet length detecting sensor.

The registration adjusting device 153 includes feeding roller pairs 227, 228, 229 and 230, and feeds the sheet, fed from the elongated sheet feeder 152, to the sheet feeding device 2. The registration adjusting device 153 adjusts (corrects) oblique movement of the sheet and positional derivation of the sheet with respect to a widthwise direction perpendicular to the feeding direction, and delivers the sheet to the entrance portion 601 of the sheet feeding device 2. Incidentally, from the viewpoint of cost reduction, the elongated sheet feeder 152 and the registration adjusting device 153 have a constitution in which a sensor for detecting the presence or absence of the sheet and a sensor for detecting the jam of the sheet are not provided. For that reason, the elongated sheet feeder 152 and the registration adjusting device 153 cannot detect a sheet absence state of the sheet accommodating portion 203 and abnormal feeding of the sheet during sheet feeding, such as the jam during the sheet feeding.

(Controller)

Figure 4:
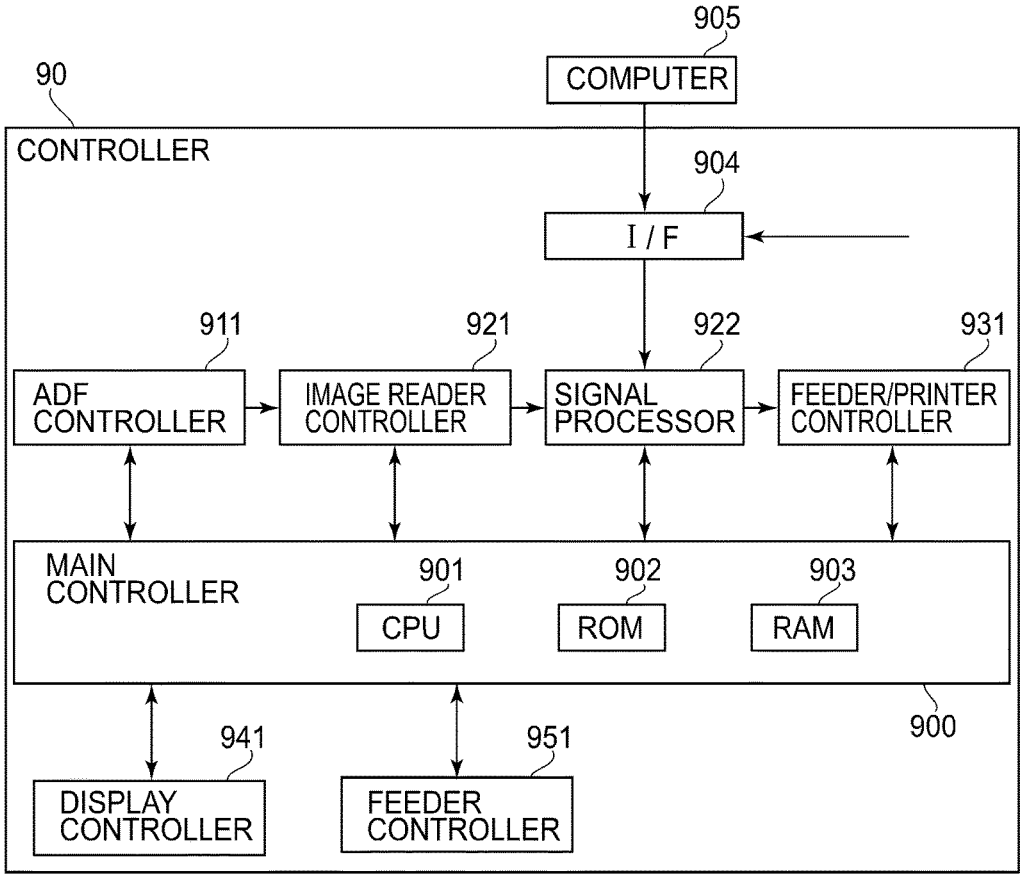
FIG. 4 is a schematic view of an example of a structure of a controller.

FIG. 4 is a schematic view of an example of a structure of a controller 90 for controlling a general operation of an image forming system 1.

The controller 90 includes a main controller 900 for controlling operations of respective portions of the image forming system 1. To the main controller 900, an ADF controller 911, an image reader controller 921, an image signal processing portion 922, sheet feeding (printer controller 931, an operation display controller 941 and an elongated sheet feeder controller 951 are connected. The main controller 900 includes a CPU 901, an ROM (read only memory) 902 and an RAM (random access memory) 903. To the image signal processing portion 922, an external interface (I/F) 904 is connected, so that the image signal processing portion 922 is capable of receiving data from a computer 905 which is an external device, via the external I/F 904.

The CPU 901 carries out control of an entirety of the image forming system 1. To the CPU 901, the ROM 902 in which a control program is stored and the RAM 903 which is an operation (working) area during execution of processing are connected. The CPU 901 executes the control program, stored in the ROM 902, using the RAM 903 as the operation area, and thus effects integrated control of operations of the respective portions.

The ADF controller 911 carried out drive control the ADF 100 on the basis of an instruction from the main controller 900. The ADF 100 feeds the sheet by the control of the ADF controller 911. The image reader controller 921 carries out drive control of the image reader 200 on the basis of an instruction from the main controller 900. The image reader 200 reads the original image by control of the image reader controller 921 controlling the scanner user 104, the image sensor 109 and the like. The image reader controller 921 transfers image data, to the image signal processing portion 922, which is an analog image signal outputted from the image sensor 109.

The image signal processing portion 922 converts the image data which is the analog image signal, transferred from the image sensor 109, into a digital signal and then performs various processes, and outputs image data, which is a digital signal after being processed, to the sheet feeding printer controller 931. Further, the image signal processing portion 922 subjects a digital image signal, inputted from the computer 905 via the external I/F 904, to various processes, and converts the digital image signal into image data, and then outputs the image data to the sheet feeding/printer controller 931. The sheet feeding/printer controller 931 controls the exposure portion 110, the printer 350 and the sheet feeding device 2 on the basis of the inputted image data in accordance with an instruction from the main controller 900, and thus carried out the image formation and the image forming process such as the sheet feeding.

The elongated sheet feeder controller 951 is mounted in the elongated sheet feeder 152 and controls the elongated sheet feeder 152 and the registration adjusting device 153 on the basis of an instruction from the main controller 900. The elongated sheet feeder 152 and the registration adjusting device 153 feed the sheet under control of the elongated sheet feeder controller 951. The operation display controller 941 transfers data between the operation display device 600 and the main controller 900. The operation display device 600 inputs key signals, corresponding to operations of the respective keys, to the main controller 900. The operation display device 600 causes the display portion 620 to display information or the like indicating a setting condition depending on data acquired from the main controller 900. Operations of the image forming apparatus 10 and the sheet feeding device 2 illustrated in FIG. 1 are controlled by the sheet feeding/printer controller 931. An operation of the elongated sheet feeder 152 is controlled by the elongated sheet feeder controller 951. The image forming apparatus 10 recognizes connection of the sheet feeding device 2 and the elongated sheet feeder 152 on an upstream side with respect to the sheet feeding direction by an unshown communication interface.

(Other Examples of Structure of Image Forming System)

Figure 5:
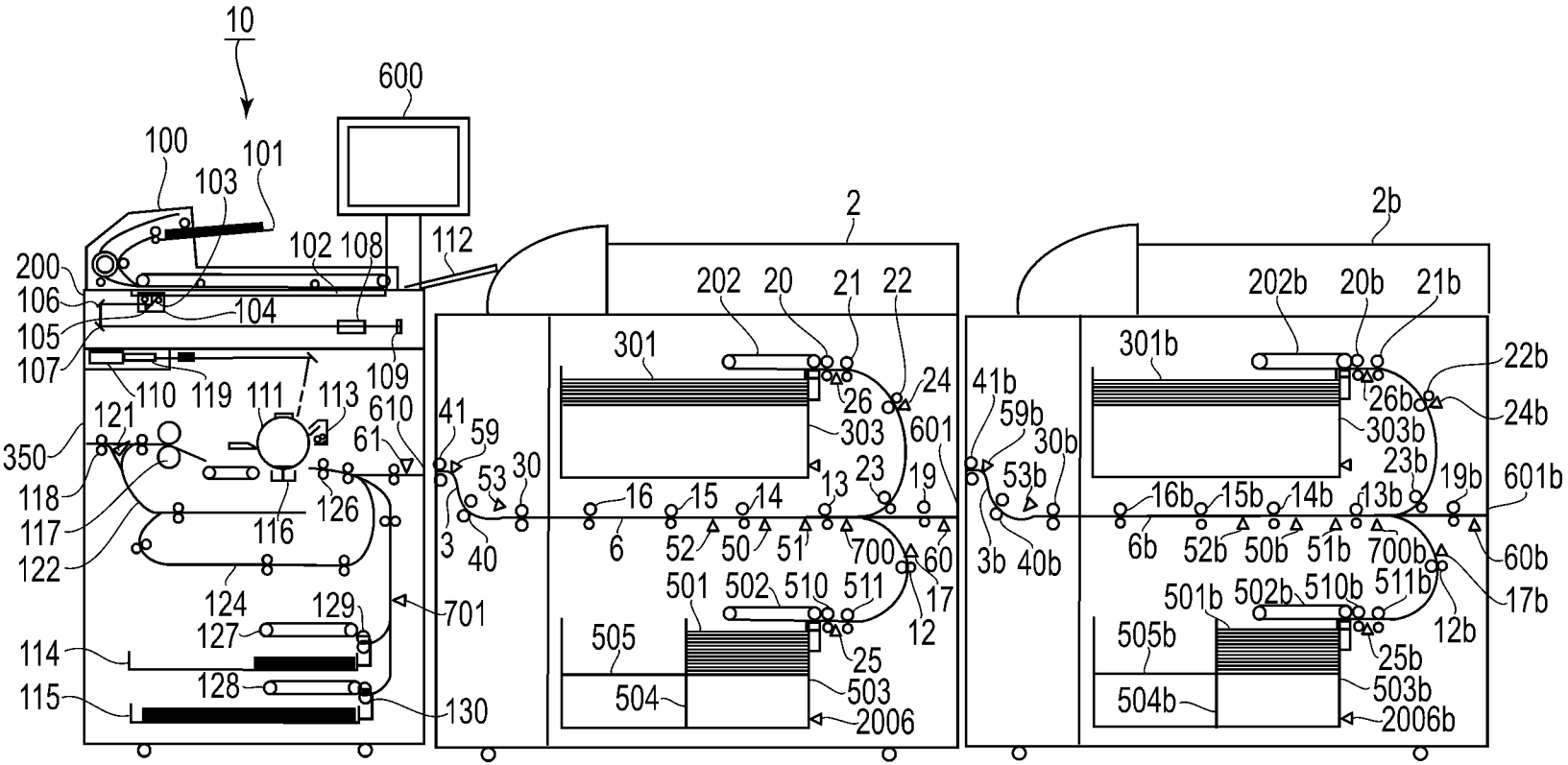
FIG. 5 is a schematic view of another example of the structure of the image forming system.
Figure 6:
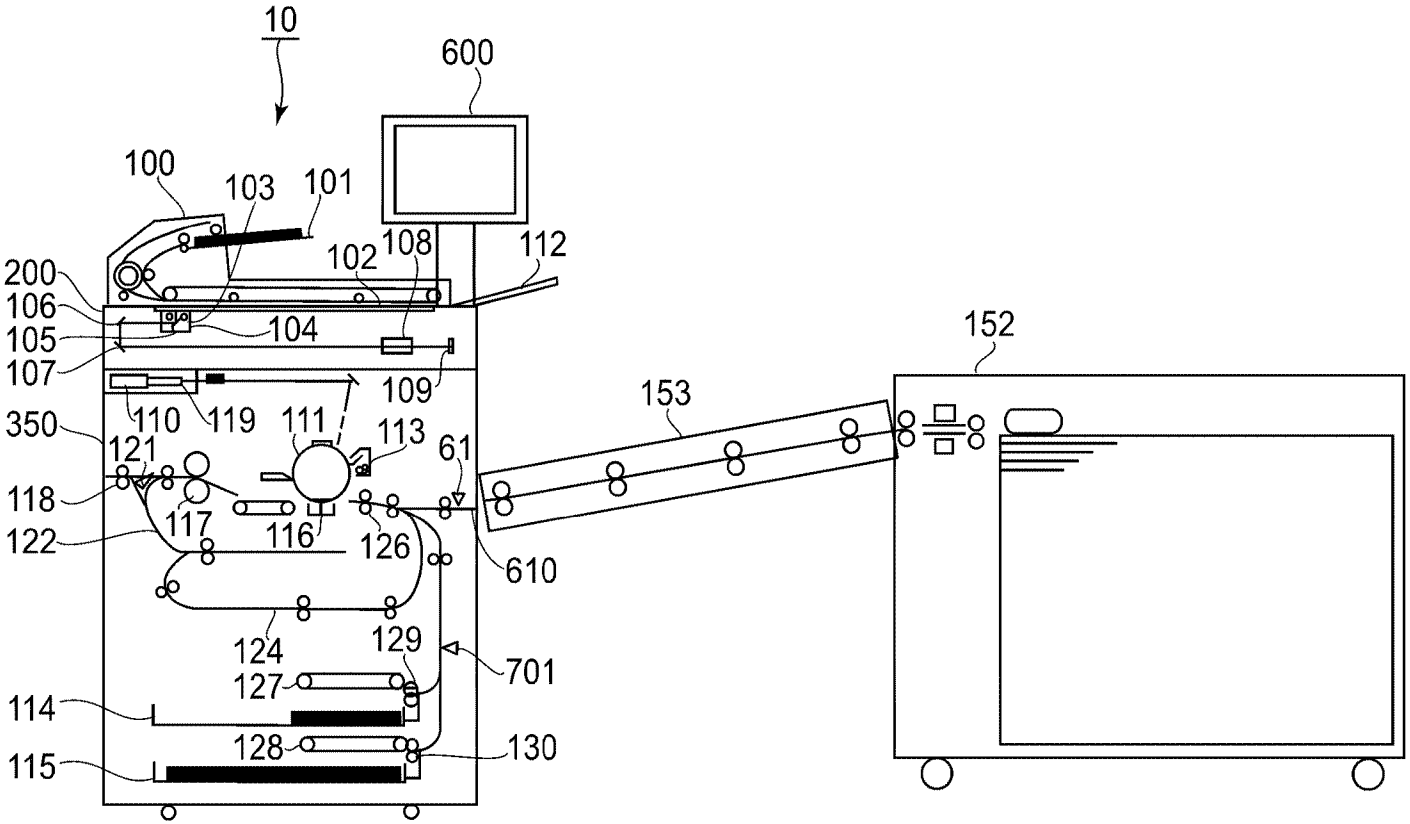
FIG. 6 is a schematic view of another example of the structure of the image forming system.
Figure 7:
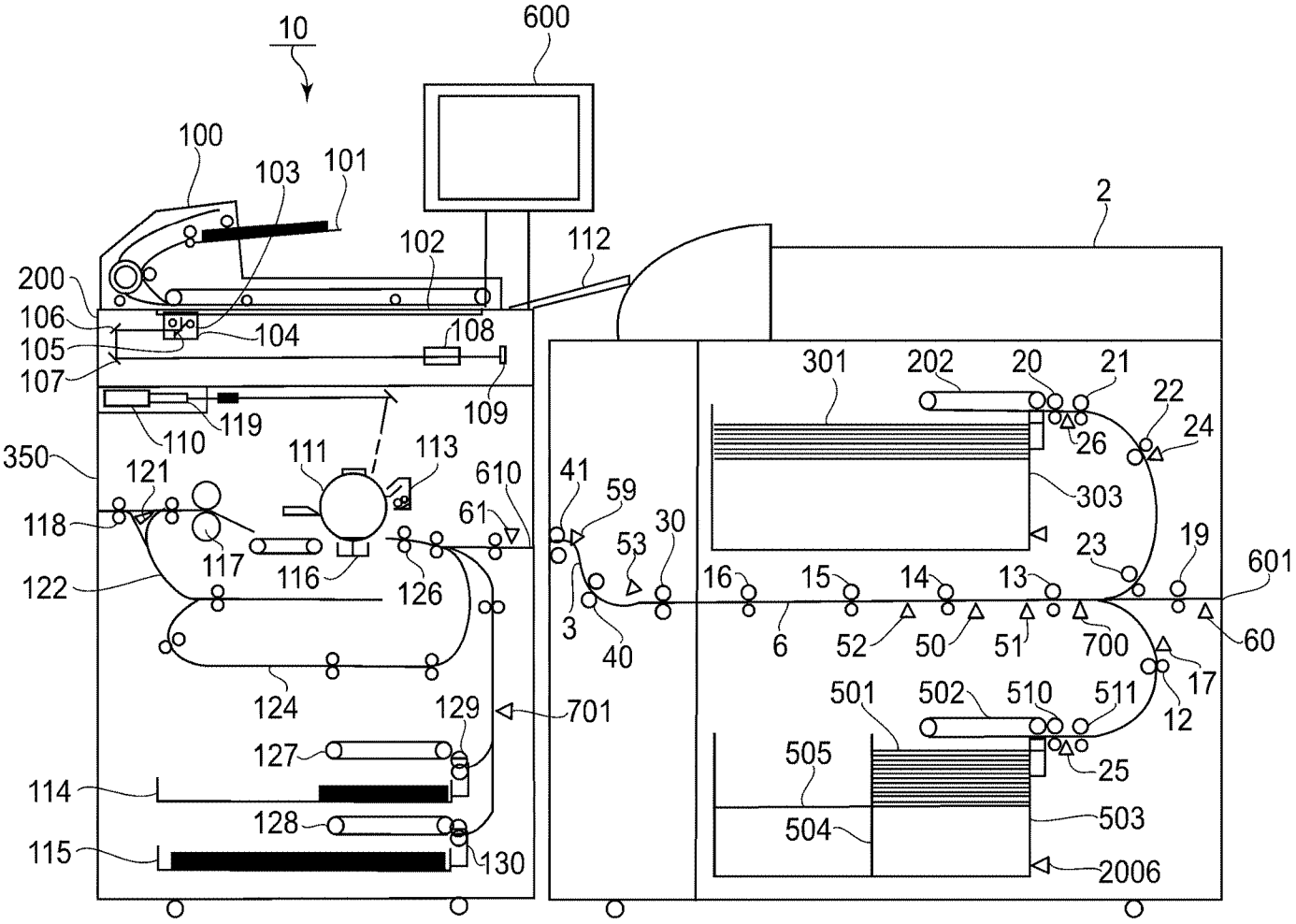
FIG. 7 is a schematic view of another example of the structure of the image forming system.

FIGS. 5 to 7 are schematic views showing other examples of the structure of the image forming system 1. The image forming apparatus 10, the sheet feeding device 2 and the elongated sheet feeder 152 are capable of constituting image forming systems in various combinations.

The image forming system shown in FIG. 5 is constituted by the image forming apparatus 10, the sheet feeding device 2 and a sheet feeding device 2*b* having the same constitution as the sheet feeding device 2. Operations of the image forming apparatus 10, the sheet feeding device 2 and the sheet feeding device 2*b* are controlled by the main controller 900. The image forming apparatus 10 recognizes connection of the sheet feeding devices 2 and 2*b* on an upstream side with respect to the sheet feeding direction by an unshown communication interface.

The image forming system shown in FIG. 6 is constituted by the image forming apparatus 10 and the elongated sheet feeder 152 including the registration adjusting device 153 by removing the sheet feeding device 2 from the system constitution shown in FIG. 1. An operation of the image forming apparatus 10 is controlled by the main controller 900. An operation of the elongated sheet feeder 152 is controlled by the elongated sheet feeder controller 951. The image forming apparatus 10 recognizes connection of the elongated sheet feeder 152 on an upstream side with respect to the sheet feeding direction by an unshown communication interface.

The image forming system shown in FIG. 7 is constituted by the image forming apparatus 10 and the sheet feeding device 2 by removing the elongated sheet feeder 152 including the registration adjusting device 153 from the system constitution shown in FIG. 1. Operations of the image forming apparatus 10 and the sheet feeding device 2 are controlled by the main controller 900. The image forming apparatus 10 recognizes connection of the sheet feeding device 2 on an upstream side with respect to the sheet feeding direction by an unshown communication interface.

(Sheet Feeding Process)

A sheet feeding process of the image forming system in each of the constitutions of FIGS. 1, 5, 6 and 7 will be described with reference to a schematic view of an example of a screen displayed at the display portion 620 of FIG. 8 and flowcharts showing sheet feeding process in FIGS. 9 to 12. When the sheet is delivered between the devices, the devices detect either one of the delay jam and the stagnation jam. For that reason, the sheet feeding process include a process of notifying a user of contents of the jam occurred, during occurrence of the jam. As shown in FIGS. 1, 5, 6 and 7 on a side upstream of the image forming apparatus 10 with respect to the sheet feeding direction, the elongated sheet feeder 152 as a sheet feeding device which does not notify abnormal feeding of the sheet or the sheet feeding device 2 which notifies the abnormal feeding of the sheet is connectable to the image forming apparatus 10. Depending on a kind of the sheet feeding device connected to the image forming apparatus 10 on the side upstream of the image forming apparatus 10 with respect to the sheet feeding direction, discrimination of a jam occurrence place and jam notification contents are different in the image forming systems of FIGS. 1, 5, 6 and 7. In the processes shown in FIGS. 9 to 12, the case where the sheet is fed from the device provided at an upstreammost position of the sheet feeding direction will be described. The printer 350 is capable of detecting the delay jam and the stagnation jam even by the sensor other than the entrance sensor 61, but in the following description, a process during jam detection by the sensor other than the entrance sensor 61 is omitted.

(Sheet Feeding Process by Image Forming System of FIG. 1)

FIG. 9 is a flowchart showing the sheet feeding process by the image forming system of FIG. 1.

When a print job for feeding the sheet from the elongated sheet feeder 152 is inputted from the operation display device 600 or the computer 905, the main controller 900 provides an instruction to feed the sheet from the elongated sheet feeder 152 to the elongated sheet feeder controller 951 (S1000). As a result, the elongated sheet feeder 152 starts the sheet feeding. The main controller 900 is on stand-by for a lapse of a predetermined time from the sheet feeding instruction to timing when the sheet is predicted to reach a detecting position of the entrance sensor 60 of the sheet feeding device 2 (S1001). After the stand-by for the lapse of the predetermined time (at the above-described timing), the main controller 900 discriminates whether or not the entrance sensor 60 of the sheet feeding device 2 detects (ON) the sheet (S1002).

In the case where the entrance sensor 60 is OFF, i.e., the sheet is not detected by the entrance sensor 60 (NO of S1002), the main controller 900 discriminates that the abnormal feeding occurred in the elongated sheet feeder 152. In this case, the main controller 900 causes the display portion 620 to display a message prompting the user to check a sheet absence state of the sheet accommodating portion 203 of the elongated sheet feeder 152 or occurrence of the jam in the feeding path from the elongated sheet feeder 152 to the sheet feeding device 2 (S1015). Part 8*a*) of FIG. 8 is a schematic view of a display example of such a message. The main controller 900 causes the display portion 620 to display such a message since the main controller 900 cannot be discriminates whether the cause that the sheet is not fed from the elongated sheet feeder 152 to the sheet feeding device 2 is the sheet absence state or the occurrence of the jam. The main controller 900 notifies the user of the abnormality of the image forming system by causing the display portion 620 to display the message and ends the sheet feeding process.

In the case where the entrance sensor 60 is ON, i.e., detects the sheet (YES of S1002), the main controller 900 causes the sheet feeding/printer controller 931 to control drive of the respective rollers in the sheet feeding device 2, so that the sheet is fed in the sheet feeding device 2. The main controller 900 is on stand-by for a lapse of a predetermined time to timing when the sheet is predicted to pass through the detecting position of the entrance sensor 60 of the sheet feeding device 2 (S1004). The main controller 900 discriminates whether or not the entrance sensor 60 does not detect (OFF) the sheet by passing of the sheet through the detecting position of the entrance sensor 60 of the sheet feeding device 2 after the lapse of the predetermined time (S1005). In the case where the entrance sensor 60 is ON, i.e., the sheet does not pass through the detecting position (NO of S1005), the main controller 900 discriminates that the stagnation jam occurred in the sheet feeding device 2. In this case, the main controller 900 causes the display portion 620 to display a jam screen indicating that the jam occurred in the sheet feeding device 2 (S1014). The main controller 900 notifies the user of abnormality of the image forming system by causing the display portion 620 to display the jam screen, and ends the sheet feeding process.

In the case where the entrance sensor 60 is OFF, i.e., the sheet passed through the detecting position (YES of S1005), the main controller 900 is on stand-by for a lapse of a predetermined time to timing when the sheet is predicted to reach the detecting position of the sheet detecting sensor 52 of the sheet feeding device 2 (S1006). The main controller 900 discriminates whether or not the sheet detecting sensor 52 detects (ON) the sheet after the lapse of the predetermined time (S1007). In the case where the sheet detecting sensor 52 is OFF, i.e., the sheet does not reach the detecting position (NO of S1007), the main controller 900 discriminates that the delay jam occurred in the sheet feeding device 2. In this case, the main controller 900 causes the display portion 620 to display a jam screen indicating that the jam occurred in the sheet feeding device 2 (S1014). The main controller 900 notifies the user of abnormality of the image forming system by causing the display portion 620 to display the jam screen, and ends the sheet feeding process.

In the case where the sheet detecting sensor 52 is ON, i.e., detects the sheet (YES of S1007), the main controller 900 is on stand-by for a lapse of a predetermined time to timing when the sheet is predicted to pass through the detecting position of the sheet detecting sensor 52 of the sheet feeding device 2 (S1008). The main controller 900 discriminates whether or not the sheet detecting sensor 52 does not detect (OFF) the sheet by passing of the sheet through the detecting position of the sheet detecting sensor 52 of the sheet feeding device 2 after the lapse of the predetermined time (S1009). In the case where the sheet detecting sensor 52 is ON, i.e., the sheet does not pass through the detecting position (NO of S1009), the main controller 900 discriminates that the stagnation jam occurred in the sheet feeding device 2. In this case, the main controller 900 causes the display portion 620 to display a jam screen indicating that the jam occurred in the sheet feeding device 2 (S1014). The main controller 900 notifies the user of abnormality of the image forming system by causing the display portion 620 to display the jam screen, and ends the sheet feeding process.

In the case where the sheet detecting sensor 52 is OFF, i.e., the sheet passed through the detecting position (YES of S1009), the main controller 900 is on stand-by for a lapse of a predetermined time to timing when the sheet is predicted to reach the detecting position of the entrance sensor 61 of the printer 350 (S1010). The main controller 900 discriminates whether or not the entrance sensor 61 detects (ON) the sheet after the lapse of the predetermined time (S1011). In the case where the entrance sensor 61 is OFF, i.e., the sheet does not reach the detecting position and there is no notification of the surface from the sheet feeding device 2 (NO of S1011), the main controller 900 discriminates that the delay jam occurred at an entrance of the printer 350. In this case, the main controller 900 causes the display portion 620 to display a jam screen indicating that the jam occurred at the entrance of the printer 350 (S1014). The main controller 900 notifies the user of abnormality of the image forming system by causing the display portion 620 to display the jam screen, and ends the sheet feeding process.

In the case where the entrance sensor 61 is ON, i.e., detects the sheet (YES of S1011), the main controller 900 causes the sheet feeding printer controller 931 to drive and control the respective rollers in the printer 350, so that the sheet is fed inside the printer 350. The main controller 900 causes the sheet feeding/printer controller 931 to form an image on the fed sheet depending on the print job and then to discharge the sheet (S1012). The main controller discriminates whether or not images are formed on sheets designated in number by the print job and the sheet feeding should be ended (S1013). In the case where the surface feeding is not ended (NO of S1013), the main controller 900 repetitively performs processes on and after S1000 until final sheet feeding is ended. In the case where the sheet feeding is ended (YES of S1013), the main controller 900 ends the sheet feeding device.

Part (b) of FIG. 8 is a schematic view of an example of the jam screen displayed in the process of S1014. This jam screen displays a star (★) at the position of the entrance sensor 61 of the printer 350 and the position of the star represents a jam occurrence position. Further, a message prompting the user to remove the sheet jammed at the position of the star. In the case where the jam occurred at another position, the star is displayed at an associated jam occurrence position. Each of the sheet feeding device 2 and the printer 350 have a constitution in which the sheet absence state and the abnormal feeding such as the delay jam or the stagnation jam can be detected by the various sensors incorporated therein and the cause of the abnormal feeding can be identified. In the above-described process, a device and a position in which the abnormal feeding occurred are identified on the basis of a detection result of the sensor used for detecting the jam. The jam screen is displayed for notifying the user of information so as to clarify the device and the position in which the abnormal feeding occurred.

(Sheet Feeding Process by Image Forming System of FIG. 5)

FIG. 10 is a flowchart showing the sheet feeding process by the image forming system of FIG. 5.

When a print job for feeding the sheet by the sheet feeding device 2*b* is inputted from the operation display device 600 or the computer 905, the main controller 900 provides an instruction to feed the sheet from the sheet feeding device 2*b* to the sheet feeding/printer controller 931 (S2000). The main controller 900 causes the sheet feeding printer controller 931 to drive and control the rollers of the sheet feeding device 2*b*, so that the sheet is fed and conveyed (S2001). The main controller 900 is on stand-by for a lapse of a predetermined time from a start of the sheet feeding by the sheet feeding device 2*b* to timing when the sheet is predicted to reach a detecting position of the sheet detecting sensor 52*b* of the sheet feeding device 2*b* (S2002). After the stand-by for the lapse of the predetermined time, the main controller 900 discriminates whether or not the sheet detecting sensor 52*b* of the sheet feeding device 2*b* detects (ON) the sheet (S2003). In the case where the sheet detecting sensor 52*b* of the sheet feeding device 2*b* is ON, i.e., the sheet is not detected (NO of S2003), the main controller 900 discriminates that the delay jam occurred in the sheet feeding device 2*b*. In this case, the main controller 900 causes the display portion 620 to display a jam screen indicating that the jam occurred in the sheet feeding device 2*b* (S2019). The main controller 900 notifies the user of abnormality of the image forming system by causing the display portion 620 to display the jam screen, and ends the sheet feeding process.

In the case where the sheet detecting sensor 52*b* of the sheet feeding device 2*b* is ON, i.e., detects the sheet (YES of S2003), the main controller 900 is on stand-by for a lapse of a predetermined time, i.e., is on stand-by for the lapse of the predetermined time to timing when the sheet is predicted to pass through the detecting position of the sheet detecting sensor 52*b* of the sheet feeding device 2*b* (S2004). The main controller 900 discriminates whether or not the sheet detecting sensor 52*b* does not detect OFF the sheet by passing of the sheet through the detecting position of the sheet detecting sensor 52*b* after the lapse of the predetermined time (S2005). In the case where the sheet detecting sensor 52*b* is ON, i.e., the sheet does not pass through the detecting position (NO of S2005), the main controller 900 discriminates that the stagnation jam occurred in the sheet feeding device 2*b*. In this case, the main controller 900 causes the display portion 620 to display a jam screen indicating that the jam occurred in the sheet feeding device 2*b* (S2019). The main controller 900 notifies the user of abnormality of the image forming system by causing the display portion 620 to display the jam screen, and ends the sheet feeding process.

In the case where the sheet detecting sensor 52*b* is OFF, i.e., the sheet passes through the detecting position (YES of S2005), the main controller 900 is on stand-by for a lapse of a predetermined time to timing when the sheet is predicted to reach the detecting position of the entrance sensor 60 of the sheet feeding device 2 (S2006). The main controller 900 discriminates whether or not the entrance sensor 60 does not detect (ON) the sheet after the lapse of the predetermined time (at the above-described timing) (S2007). In the case where the entrance sensor 60 is OFF, i.e., the sheet does not reach the detecting position and there is no notification of the jam from the sheet feeding device 2*b* (NO of S2007), the main controller 900 discriminates that the jam occurred at the entrance of the sheet feeding device 2. In this case, the main controller 900 causes the display portion 620 to display a jam screen indicating that the jam occurred at the entrance of the sheet feeding device 2 (S2019). The main controller 900 notifies the user of abnormality of the image forming system by causing the display portion 620 to display the jam screen, and ends the sheet feeding process.

In the case where the entrance sensor 60 is ON, i.e., detects the sheet (YES of S2007), the main controller 900 causes the sheet feeding/printer controller 931 to control drive of the respective rollers in the sheet feeding device 2, so that the sheet is fed inside the sheet feeding device 2 (S2008). As a result, the sheet feeding device 2 starts feeding of the sheet received from the sheet feeding device 2*b*. The main controller 900 is on stand-by for a lapse of a predetermined time to timing when the sheet is predicted to pass through the detecting position of the entrance sensor 60 of the sheet feeding device 2 (S2009). The main controller 900 discriminates whether or not the entrance sensor 60 does not detect (OFF) the sheet by passing of the sheet through the detecting position of the entrance sensor 60 of the sheet feeding device 2 after the lapse of the predetermined time (S2010). In the case where the entrance sensor 60 is ON, i.e., the sheet does not pass through the detecting position (NO of S2010), the main controller 900 discriminates that the stagnation jam occurred in the sheet feeding device 2. In this case, the main controller 900 causes the display portion 620 to display a jam screen indicating that the jam occurred in the sheet feeding device 2 (S2019). The main controller 900 notifies the user of abnormality of the image forming system by causing the display portion 620 to display the jam screen, and ends the sheet feeding process.

In the case where the entrance sensor 60 is OFF, i.e., the sheet passed through the detecting position (YES of S2010), the main controller 900 is on stand-by for a lapse of a predetermined time to timing when the sheet is predicted to reach the detecting position of the sheet detecting sensor 52 of the sheet feeding device 2 (S2011). The main controller 900 discriminates whether or not the sheet detecting sensor 52 detects (ON) the sheet after the lapse of the predetermined time (S2012). In the case where the sheet detecting sensor 52 is OFF, i.e., the sheet does not reach the detecting position (NO of S2012), the main controller 900 discriminates that the delay jam occurred in the sheet feeding device 2. In this case, the main controller 900 causes the display portion 620 to display a jam screen indicating that the jam occurred in the sheet feeding device 2 (S2019). The main controller 900 notifies the user of abnormality of the image forming system by causing the display portion 620 to display the jam screen, and ends the sheet feeding process.

In the case where the sheet detecting sensor 52 is ON, i.e., detects the sheet (YES of S2013), the main controller 900 is on stand-by for a lapse of a predetermined time to timing when the sheet is predicted to pass through the detecting position of the sheet detecting sensor 52 of the sheet feeding device 2 (S2013). The main controller 900 discriminates whether or not the sheet detecting sensor 52 does not detect (OFF) the sheet by passing of the sheet through the detecting position of the sheet detecting sensor 52 of the sheet feeding device 2 after the lapse of the predetermined time (S2014). In the case where the sheet detecting sensor 52 is ON, i.e., the sheet does not pass through the detecting position (NO of S2014), the main controller 900 discriminates that the stagnation jam occurred in the sheet feeding device 2. In this case, the main controller 900 causes the display portion 620 to display a jam screen indicating that the jam occurred in the sheet feeding device 2 (S2019). The main controller 900 notifies the user of abnormality of the image forming system by causing the display portion 620 to display the jam screen, and ends the sheet feeding process.

In the case where the sheet detecting sensor 52 is OFF, i.e., the sheet passed through the detecting position (YES of S2014), the main controller 900 is on stand-by for a lapse of a predetermined time to timing when the sheet is predicted to reach the detecting position of the entrance sensor 61 of the printer 350 (S2015). The main controller 900 discriminates whether or not the entrance sensor 61 detects (ON) the sheet after the lapse of the predetermined time (S2016). In the case where the entrance sensor 61 is OFF, i.e., the sheet does not reach the detecting position and there is no notification of the surface from the sheet feeding device 2 (NO of S2016), the main controller 900 discriminates that the delay jam occurred at an entrance of the printer 350. In this case, the main controller 900 causes the display portion 620 to display a jam screen indicating that the jam occurred at the entrance of the printer 350 (S2019). The main controller 900 notifies the user of abnormality of the image forming system by causing the display portion 620 to display the jam screen, and ends the sheet feeding process.

In the case where the entrance sensor 61 is ON, i.e., detects the sheet (YES of S2016), the main controller 900 causes the sheet feeding printer controller 931 to drive and control the respective rollers in the printer 350, so that the sheet is fed inside the printer 350. The main controller 900 causes the sheet feeding/printer controller 931 to form an image on the fed sheet depending on the print job and then to discharge the sheet (S2017). The main controller discriminates whether or not images are formed on sheets designated in number by the print job and the sheet feeding should be ended (S2018). In the case where the surface feeding is not ended (NO of S2018), the main controller 900 repetitively performs processes on and after S2000 until final sheet feeding is ended. In the case where the sheet feeding is ended (YES of S2018), the main controller 900 ends the sheet feeding device.

Part (c) of FIG. 8 is a schematic view of an example of the jam screen displayed in the process of S2019. This jam screen displays a star (★) at the position of the entrance sensor 60 of the sheet feeding device 2 and the position of the star represents a jam occurrence position. Further, a message prompting the user to remove the sheet jammed at the position of the star. In the case where the jam occurred at another position, the star is displayed at an associated jam occurrence position. Each of the sheet feeding device 2*b*, the sheet feeding device 2 and the printer 350 have a constitution in which the sheet absence state and the abnormal feeding such as the delay jam or the stagnation jam can be detected by the various sensors incorporated therein and the cause of the abnormal feeding can be identified. In the above-described process, a device and a position in which the abnormal feeding occurred are identified on the basis of a detection result of the sensor used for detecting the jam. The jam screen is displayed for notifying the user of information so as to clarify the device and the position in which the abnormal feeding occurred.

(Sheet Feeding Process by Image Forming System of FIG. 6)

FIG. 11 is a flowchart showing the sheet feeding process by the image forming system of FIG. 6.

When a print job including feeding of the sheet by the elongated sheet feeder 152 is inputted from the operation display device 600 or the computer 905, the main controller 900 provides an instruction to feed the sheet from the elongated sheet feeder 152 to the elongated sheet feeder controller 951 (S3000). As a result, the elongated sheet feeder 152 starts the sheet feeding. The main controller 900 is on stand-by for a lapse of a predetermined time from the sheet feeding instruction to timing when the sheet is predicted to reach a detecting position of the entrance sensor 61 of the printer 350 (S3001). After the stand-by for the lapse of the predetermined time (at the above-described timing), the main controller 900 discriminates whether or not the entrance sensor 61 of the printer 350 detects (ON) the sheet (S3002).

In the case where the entrance sensor 61 is OFF, i.e., the sheet is not detected by the entrance sensor 60 (NO of S3002), the main controller 900 discriminates that the abnormal feeding occurred in the elongated sheet feeder 152. In this case, the main controller 900 causes the display portion 620 to display a message prompting the user to check a sheet absence state of the sheet accommodating portion 203 of the elongated sheet feeder 152 or occurrence of the jam in the feeding path from the elongated sheet feeder 152 to the printer 350 (S3005). Part 8*a*) of FIG. 8 is a schematic view of a display example of such a message. The main controller 900 causes the display portion 620 to display such a message since the main controller 900 cannot be discriminates whether the cause that the sheet is not fed from the elongated sheet feeder 152 to the sheet feeding device 2 is the sheet absence state or the occurrence of the jam. The main controller 900 notifies the user of the abnormality of the image forming system by causing the display portion 620 to display the message and ends the sheet feeding process.

In the case where the entrance sensor 61 is ON, i.e., detects the sheet (YES of S3002), the main controller 900 causes the sheet feeding printer controller 931 to drive and control the respective rollers in the printer 350, so that the sheet is fed inside the printer 350. The main controller 900 causes the sheet feeding/printer controller 931 to form an image on the fed sheet depending on the print job and then to discharge the sheet (S3003). The main controller discriminates whether or not images are formed on sheets designated in number by the print job and the sheet feeding should be ended (S3004). In the case where the surface feeding is not ended (NO of S3004), the main controller 900 repetitively performs processes on and after S3000 until final sheet feeding is ended. In the case where the sheet feeding is ended (YES of S3004), the main controller 900 ends the sheet feeding device.

(Sheet Feeding Process by Image Forming System of FIG. 7)

FIG. 12 is a flowchart showing the sheet feeding process by the image forming system of FIG. 7.

When a print job including feeding of the sheet by the sheet feeding device 2 is inputted from the operation display device 600 or the computer 905, the main controller 900 provides an instruction to feed the sheet from the sheet feeding device 2 to the sheet feeding/printer controller 931 (S4000). The main controller 900 causes the sheet feeding printer controller 931 to drive and control the rollers of the sheet feeding device 2, so that the sheet is fed and conveyed (S4001). The main controller 900 is on stand-by for a lapse of a predetermined time from a start of the sheet feeding by the sheet feeding device 2 to timing when the sheet is predicted to reach a detecting position of the sheet detecting sensor 52 of the sheet feeding device 2 (S4002). After the stand-by for the lapse of the predetermined time, the main controller 900 discriminates whether or not the sheet detecting sensor 52 of the sheet feeding device 2 detects (ON) the sheet (S4003). In the case where the sheet detecting sensor 52 of the sheet feeding device 2 is ON, i.e., the sheet is not detected (NO of S4003), the main controller 900 discriminates that the delay jam occurred in the sheet feeding device 2. In this case, the main controller 900 causes the display portion 620 to display, a jam screen indicating that the jam occurred in the sheet feeding device 2 (S4010). The main controller 900 notifies the user of abnormality of the image forming system by causing the display portion 620 to display the jam screen, and ends the sheet feeding process.

In the case where the sheet detecting sensor 52 of the sheet feeding device 2 is ON, i.e., detects the sheet (YES of S4003), the main controller 900 is on stand-by for a lapse of a predetermined time, i.e., is on stand-by for the lapse of the predetermined time to timing when the sheet is predicted to pass through the detecting position of the sheet detecting sensor 52 of the sheet feeding device 2 (S4004). The main controller 900 discriminates whether or not the sheet detecting sensor 52 does not detect OFF the sheet by passing of the sheet through the detecting position of the sheet detecting sensor 52 after the lapse of the predetermined time (S4005). In the case where the sheet detecting sensor 52 is ON, i.e., the sheet does not pass through the detecting position (NO of S4005), the main controller 900 discriminates that the stagnation jam occurred in the sheet feeding device 2. In this case, the main controller 900 causes the display portion 620 to display a jam screen indicating that the jam occurred in the sheet feeding device 2 (S4010). The main controller 900 notifies the user of abnormality of the image forming system by causing the display portion 620 to display the jam screen, and ends the sheet feeding process.

In the case where the sheet detecting sensor 52 is OFF, i.e., the sheet passed through the detecting position (YES of S4005), the main controller 900 is on stand-by for a lapse of a predetermined time to timing when the sheet is predicted to reach the detecting position of the entrance sensor 61 of the printer 350 (S4006). The main controller 900 discriminates whether or not the entrance sensor 61 detects (ON) the sheet after the lapse of the predetermined time (at the above-described timing) (S4007). In the case where the entrance sensor 61 is OFF, i.e., the sheet does not reach the detecting position and there is no notification of the surface from the sheet feeding device 2 (NO of S4007), the main controller 900 discriminates that the delay jam occurred at an entrance of the printer 350. In this case, the main controller 900 causes the display portion 620 to display a jam screen indicating that the jam occurred at the entrance of the printer 350 (S4010). The main controller 900 notifies the user of abnormality of the image forming system by causing the display portion 620 to display a message, and ends the sheet feeding process.

In the case where the entrance sensor 61 is ON, i.e., detects the sheet (YES of S4007), the main controller 900 causes the sheet feeding printer controller 931 to drive and control the respective rollers in the printer 350, so that the sheet is fed inside the printer 350. The main controller 900 causes the sheet feeding/printer controller 931 to form an image on the fed sheet depending on the print job and then to discharge the sheet (S4008). The main controller discriminates whether or not images are formed on sheets designated in number by the print job and the sheet feeding should be ended (S4009). In the case where the surface feeding is not ended (NO of S4009), the main controller 900 repetitively performs processes on and after S4000 until final sheet feeding is ended. In the case where the sheet feeding is ended (YES of S4009), the main controller 900 ends the sheet feeding device.

Part (d) of FIG. 8 is a schematic view of an example of the jam screen displayed in the process of S4010. This jam screen displays a star (★) at the position of the entrance sensor 61 of the image forming apparatus 10 (printer 350) and the position of the star represents a jam occurrence position. Further, a message prompting the user to remove the sheet jammed at the position of the star. In the case where the jam occurred at another position, the star is displayed at an associated jam occurrence position. Each of the sheet feeding device 2 and the printer 350 have a constitution in which the sheet absence state and the abnormal feeding such as the delay jam or the stagnation jam can be detected by the various sensors incorporated therein and the cause of the abnormal feeding can be identified. In the above-described process, a device and a position in which the abnormal feeding occurred are identified on the basis of a detection result of the sensor used for detecting the jam. The jam screen is displayed for notifying the user of information so as to clarify the device and the position in which the abnormal feeding occurred.

In each of the screens of (b), (c) and (d) of FIG. 8, a source of occurrence of the abnormality is shown in an easy-to-understand manner by displaying the star (★) representing the device and the position, in which the abnormality occurred, in a layout image of an entirety of the image forming system. The main controller 900 is capable of such display in order to grasp a constitution of one or more device connectable to the image forming apparatus 10 on the upstream side with respect to the sheet feeding direction.

Information indicating the constitution of the device(s) connectable to the image forming apparatus 10 on the upstream side is stored in the RAM 903, for example.

In the above description of the elongated sheet feeder 152 and the registration adjusting device 153, the constitution in which the sensor for detecting the jam during the sheet feeding was not provided was employed. However, the present invention is applicable to even a constitution in which a sensor for detecting a sheet (paper) remaining on a feeding path in a stand-by state in which no feeding of the sheet is carried out and occurrence of the jam during the sheet feeding is not detected by this sensor.

As described above, the image forming system of this embodiment consisting of a plurality of devices discriminates that in the case where the delay jam is detected at the entrance portion of the device for receiving the sheet, the abnormality regarding the sheet feeding occurred in the device for delivering (feeding) the sheet. The image forming system notifies the user of the device in which the abnormality occurred. As a result, the image forming system can accurately notifies the user of the device in which the abnormality occurred. The user is capable of taking appropriate action during the occurrence of the abnormality. For that reason, usability of the image forming system is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-108336 filed on May 31, 2017, which is hereby incorporated by reference herein in its entirety.

What is claimed is:

1. An image forming apparatus to which a first feeding device which does not notify abnormal feeding of a sheet during sheet feeding therein or a second feeding device which notifies the abnormal feeding of the sheet during the sheet feeding therein is connectable, said image forming apparatus comprising:

a sheet receiving portion configured to receive the sheet from the first feeding device or the second feeding device;

a detector provided at said sheet receiving portion and configured to detect the sheet received by said sheet receiving portion;

an image forming unit configured to form an image on the sheet received by said sheet receiving portion; and a controller configured to discriminate occurrence of the abnormal feeding of the sheet, wherein in a case that the first feeding device is connected to said image forming apparatus, said controller discriminates that the abnormal feeding of the sheet occurs in the first feeding device when said detector does not detect the sheet at first timing of the sheet fed from the first feeding device being predicted to reach said detector, and in a case that the second feeding device is connected to said image forming apparatus, said controller discriminates that the abnormal feeding of the sheet occurs at said sheet receiving portion when said detector does not detect the sheet at second timing of the sheet fed from the second feeding device being predicted to reach said detector and notification of the abnormal feeding of the sheet is not provided from the second feeding device.

2. An image forming apparatus according to claim 1, further comprising a notifying unit configured to notify information, wherein said controller controls said notifying unit so as to notify a device or a position in which the abnormal feeding of the sheet occurs.

3. An image forming apparatus according to claim 2, wherein when said image forming apparatus is connected with said first sheet feeding device and said controller discriminates that the abnormal feeding of the sheet occurs in said first sheet feeding device, said controller controls said notifying unit so as to notify a user of a message prompting the user to check a sheet absence state of said first sheet feeding device or occurrence of the abnormal feeding of the sheet in a feeding path of said first sheet feeding device.

4. An image forming apparatus according to claim 2, wherein when said image forming apparatus is connected with said second sheet feeding device and said controller discriminates that the abnormal feeding of the sheet occurs in said second sheet feeding device, said controller controls said notifying unit so as to display a mark indicating the position in which the abnormal feeding of the sheet occurs.

5. An image forming system comprising:

a predetermined sheet feeding device to which a first feeding device which does not notify abnormal feeding of a sheet during sheet feeding therein or a second feeding device which notifies the abnormal feeding of the sheet during the sheet feeding therein is connectable on a side upstream thereof with respect to a sheet feeding direction;

an image forming unit configured to form an image on the sheet received from said predetermined sheet feeding device; and a controller configured to control said second sheet feeding device and said image forming apparatus, wherein said predetermined sheet feeding device comprises, a sheet receiving portion configured to receive the sheet from said first feeding device or said second feeding device, and a detector configured to detect the sheet received by said sheet receiving portion, wherein in a case that said first feeding device is connected to said predetermined sheet feeding device and the sheet is fed from said first sheet feeding device, said controller discriminates that the abnormal feeding of the sheet occurs in said first feeding device when said detector does not detect the sheet at first timing of the sheet fed from said first feeding device being predicted to reach said detector, and in a case that the second feeding device is connected to said predetermined sheet feeding device and the sheet is fed from said second sheet feeding device, said controller discriminates that the abnormal feeding of the sheet occurs at said sheet receiving portion when said detector does not detect the sheet at second timing of the sheet fed from said second feeding device being predicted to reach said detector and notification of the abnormal feeding of the sheet is not provided from said second feeding device.

6. An image forming system according to claim 5, further comprising a notifying unit configured to notify information, wherein said controller controls said notifying unit so as to notify a device or a position in which the abnormal feeding of the sheet occurs.

7. An image forming system according to claim 6, wherein when said image forming apparatus is connected with said first sheet feeding device and said controller discriminates that the abnormal feeding of the sheet occurs in said first sheet feeding device, said controller controls said notifying unit so as to notify a user of a message prompting the user to check a sheet absence state of said first sheet feeding device or occurrence of the abnormal feeding of the sheet in a feeding path of said first sheet feeding device.

8. An image forming system according to claim 6, wherein when said image forming apparatus is connected with said second sheet feeding device and said controller discriminates that the abnormal feeding of the sheet occurs in said second sheet feeding device, said controller controls said notifying unit so as to display a mark indicating the position in which the abnormal feeding of the sheet occurs.

9. A detecting method of abnormal feeding of a sheet in an image forming apparatus, wherein the image forming apparatus to which a first feeding device which does not notify abnormal feeding of the sheet during sheet feeding therein or a second feeding device which notifies the abnormal feeding of the sheet during the sheet feeding therein is connectable, and includes a sheet receiving portion configured to receive the sheet from the first feeding device or the second feeding device, and a detector provided at the sheet receiving portion and configured to detect the sheet received by the sheet receiving portion, said detecting method comprising:

discriminating that the abnormal feeding of the sheet occurs in the first feeding device when the first feeding device is connected to the image forming apparatus and the detector does not detect the sheet at first timing of the sheet fed from the first feeding device being predicted to reach the detector; and discriminating that the abnormal feeding of the sheet occurs at said sheet receiving portion when the second feeding device is connected to said image forming apparatus and the detector does not detect the sheet at second timing of the sheet fed from the second feeding device being predicted to reach the detector and notification of the abnormal feeding is not provided from the second feeding device.

10. A detecting method of abnormal feeding of a sheet in an image forming apparatus, wherein the image forming system includes a predetermined sheet feeding device to which a first feeding device which does not notify abnormal feeding of the sheet during sheet feeding therein or a second feeding device which notifies the abnormal feeding of the sheet during the sheet feeding therein is connectable, and an image forming unit configured to form an image on the sheet received from said predetermined sheet feeding device and wherein said predetermined sheet feeding device includes a sheet receiving portion configured to receive the sheet from the first feeding device or the second feeding device, and a detector configured to detect the sheet received by the sheet receiving portion, said detecting method comprising:

discriminating that the abnormal feeding of the sheet occurs in the first feeding device when the first feeding device is connected to the image forming apparatus and the detector does not detect the sheet at first timing of the sheet fed from the first feeding device being predicted to reach the detector; and discriminating that the abnormal feeding of the sheet occurs at said sheet receiving portion when the second feeding device is connected to said image forming apparatus and the detector does not detect the sheet at second timing of the sheet fed from the second feeding device being predicted to reach the detector and notification of the abnormal feeding of the sheet is not provided from the second feeding device.

* * * * *